United States Patent [19]

Andress

[11] Patent Number: 4,744,798

[45] Date of Patent: May 17, 1988

[54] BENZOPHENONE DERIVATIVES AS FUEL ADDITIVES

[75] Inventor: Harry J. Andress, Wenonah, N.J.

[73] Assignee: Mobil Oil Corporation, New York, N.Y.

[21] Appl. No.: 430,196

[22] Filed: Sep. 30, 1982

[51] Int. Cl.[4] ..... C10L 1/18

[52] U.S. Cl. ..... 44/70; 44/71; 44/75; 44/78; 44/63; 564/134; 564/144; 564/169

[58] Field of Search ..... 44/78, 75, 63, 70, 71; 564/134, 144, 169

[56] References Cited

U.S. PATENT DOCUMENTS

| | | | |
|---|---|---|---|
| 3,272,746 | 9/1966 | Le Suer et al. | 44/63 |
| 3,417,114 | 12/1968 | Kuceski | 564/134 |
| 3,951,614 | 4/1976 | Honnen et al. | 44/70 |
| 4,063,010 | 12/1977 | Marie et al. | 526/139 |
| 4,088,588 | 5/1978 | Pecoraro | 44/63 |
| 4,102,798 | 6/1978 | Ryer et al. | 252/51.5 A |
| 4,116,643 | 9/1978 | Ryer et al. | 44/63 |
| 4,194,885 | 3/1980 | Audeh | 44/63 |

*Primary Examiner*—William R. Dixon, Jr.
*Assistant Examiner*—Cynthia A. Prezlock
*Attorney, Agent, or Firm*—Alexander J. McKillop; Michael G. Gilman; Howard M. Flournoy

[57] ABSTRACT

Benzophenone derivatives, e.g., benzophenone tetracarboxylic dianhydride, and esters or mixtures thereof when reacted with various hydrocarbyl amines provide additives that are highly useful as fuel detergents, intake valve and exhaust gas valve deposit reducers.

10 Claims, No Drawings

BENZOPHENONE DERIVATIVES AS FUEL ADDITIVES

BACKGROUND OF THE INVENTION

1. Field of the Invention

This invention relates to liquid hydrocarbon fuels normally susceptible to forming undesirable carburetor and intake valve deposits in automotive and other internal combustion engines. More particularly, this invention relates to liquid hydrocarbon fuels containing certain benzophenone derivatives for effecting the reduction of such deposits.

2. Description of the Prior Art

It is well known to those skilled in the art that liquid hydrocarbon fuels such as gasolines and fuel oils tend, on combustion, to form undesirable deposits on carburetor and intake valves in internal combustion engines. It is also well known that a great deal of effort has been directed to provide means to overcome such problems. The formation of such deposits tends to impair engine efficiency and often results in breakdown, necessitating cleaning operations and frequently costly replacement of engine parts. This situation is particularly critical in the use of modern liquid hydrocarbon fuels such as gasolines, jet fuels, diesel fuels and other fuels employed in the operation of advanced internal combustion engines.

Various chemical additives have been used with varying success to overcome the adverse affects described above. Nevertheless, a strong need still exists for fuel additives capable of inducing carburetor and intake valve deposits. This application is a response to that need. However, to applicant's knowledge, the benzophenone derivatives as disclosed herein have not been used or suggested by the prior art for such purpose and are novel.

SUMMARY OF THE INVENTION

In accordance with the present invention, it has been found that the undesirable formation of carburetor and intake valve deposits in internal combustion engines can be significantly reduced by adding minor amounts of benzophenone tetracarboxylic dianhydride (BTD) amine derivatives or esters thereof or mixtures of the dianhydride and esters to the liquid hydrocarbon fuels used in said internal combustion engines. The benzophenone tetracarboxylic dianhydride and its esters are reacted with various suitable amines to give said additives that are fuel detergents and which provide in particular intake valve and exhaust gas recirculation valve deposit reduction.

The liquid hydrocarbon fuels improved in accordance with the present invention comprise fuels which are normally susceptible to forming the aforementioned undesirable carburetor and intake valve deposits. Specifically, liquid hydrocarbon fuels boiling from about 75° F. to about 750° F. including gasoline, jet fuel and diesel fuel. Of particular significance is the treatment of petroleum distillate fuels having an initial boiling point of about 75° F. to about 135° F., and an end boiling point of from about 250° to about 750° F. It should be noted in this respect that the term "distillate fuels" or "distillate fuel oils" is not intended to be restricted to straight run distillate fractions. These distillate fuel oils can comprise straight run distillate fuels, catalytically or thermally cracked including hydrocracked distillate fuel oils or mixtures of straight run distillate fuel oils, naphthas and the like with cracked distillate stocks. Moreover, such fuel oils can be treated in accordance with well known commercial methods such as acid or caustic treatment, hydrogenation, solvent refining plate treatment and the like.

Distillate fuels are characterized by their relatively low viscosity, pour point, etc. The principal property which characterizes these hydrocarbons however, is their distillation range, which as hereinabove indicated, will lie between about 75° F. and about 750° F. Obviously, the distillation range of each individual fuel will cover a narrower boiling range and each fuel will boil substantially continuously throughout its distillation range. Particularly contemplated among the fuels are gasolines, leaded or unleaded; fuel oils such as Nos. 1, 2 and 3, used in heating; and jet combustion fuels. The domestic fuel oils generally conform to the specifications set forth in ASTM Specification D396-4AT. Specifications for diesel fuels are defined in ASTM Specification D975-4AT. Typical jet fuels are defined in Military Specification NIL-F-5 624B. In addition, as hereinbefore indicated, fuel oils of varying viscosity and pour points falling both within and outside the indicated range may also be effectively treated through the use of additives of the present invention.

Additives in accordance with the invention are employed in liquid hydrocarbon fuels in minor amounts, i.e., from about 0.001 to about 10 weight percent, and preferably from about 0.01 to about 0.5 weight percent based on the total weight of the fuel. Any other known additive (antioxidant, dispersant, antiwear agent, etc.) generally may also be used for its known purpose up to about 5 to 10 weight percent based on the total weight of the fuel composition without adverse effect.

In general, the benzophenone tetracarboxylic dianhydride and its derivatives may be prepared by reacting same with an appropriate amine. For example, a mixture of benzophenone tetracarboxylic dianhydride and an alkanol can be reacted to form the ester which is then reacted with a suitable hydrocarbyl amine. The esterification reaction is usually carried out under suitable nitrogen pressure at a temperature of from about 150° to about 250° C., and preferably from about 180° to about 210° C. until the reaction is substantially complete, i.e., depending on specific reaction parameters up to five hours or more. The alkyl group of the alkanol may contain from 1 to about 37–72 carbon atoms. The benzophenone dianhydride and alkanol are reacted in a mole ratio which may vary from about 1:4 to about 4:1, and preferably from about 1:4.

The product ester of the benzophenone tetracarboxylic acid may then be reacted with an amine at atmospheric pressure wherein the reaction temperature can vary from about 100° to about 300° C., and the mole ratio of ester to amine is from about 3:1 to about 1:3 for periods of from about three to ten hours.

Any suitable hydrocarbyl amine may be used; for example, polyethylene amines, polypropylene amines, primary and secondary straight chain and branched chain amines, alkenyl succinimides.

DESCRIPTION OF SPECIFIC EMBODIMENTS

The following specific examples and comparative data set forth below indicate clearly that the fuel additives and compositions of the present invention are highly effective for their intended purpose.

EXAMPLE 1

A mixture of 400 grams (1.35 moles) benzophenone tetracarboxylic dianhydride, 854 grams (5.4 moles) isodecanol, and 1 gram p-toluene sulfonic acid were stirred to about 200° C. over a five hour period using a slow stream of nitrogen gas to aid in the removal of water. The product was the tetraisodecyl ester of benzophenone tetracarboxylic acid.

EXAMPLE 2

A mixture of 980 grams (1.1 moles) of the product from Example 1 and 50 grams (0.38 moles) of tetraethylene pentamine were stirred to about 260° C. over a seven hour period to form the desired reaction product.

EXAMPLE 3

A mixture of 892 grams (1 mole) of product from Example 1 acid and 91 grams (0.48 mole) of tetraehtylene pentamine were stirred to about 250° C. over an eight hour period to form the desired reaction product.

EXAMPLE 4

A mixture of 313 grams (1.05 moles) benzophenone tetracarboxylic dianhydride and 850 grams (4.24 moles) of a commercially available mixture of branched $C_{12}$ primary amines were stirred to about 220° C. over a six hour period to form the corresponding tetra amide of benzophenone tetracarboxylic acid.

EXAMPLE 5

A mixture of 173 grams (0.58 mole) benzophenone tetracarboxylic dianhydride and 615 grams (2.32 moles) of a commercially available mixture of primary $C_{16-18}$ amines derived from tallow were stirred to about 270° C. over an eight hour period to form the tetra amide of benzophenone tetracarboxylic acid.

EXAMPLE 6

A mixture of 315 grams (1.06 moles) benzophenone tetracarboxylic dianhydride acid, 1384 grams (4.24 moles) of an aminopropyl substituted oleylamine were stirred to about 255° C. over an eight hour period to form the desired reaction product.

EXAMPLE 7

A mixture of 1018 grams (0.52 mole) of a bis-succinimide (formed by reacting one mole of tetraethylene pentamine with two moles of $C_{18}$ to $C_{24}$ dimer alkenyl succinic anhydride) and 76 grams (0.26 mole) benzophenone tetracarboxylic dianhydride were stirred to about 260° C. over a four hour period to give the desired reaction product.

The base fuel and the base fuel plus the additives as specified below were thereafter subjected to the following Carburetor Detergency Test to determine the effectiveness of fuels incorporating the additives in accordance with the invention in preventing carburetor throttle body deposits.

I. PROCEDURE

A six-cylinder, 240 cubic inch truck engine with exhaust gas recirculation is operated for twenty hours on a cycle consisting of a seven-minute idle followed by the thirty-second part-throttle acceleration to 2000 rpm. A controlled amount of the engine's blowby gas is metered into the intake air to induce deposit formation. The ability of a fuel to prevent deposit formation is determined by weighing the removable aluminum throttle sleeve before and after the test and also by a visual rating of the sleeve.

II. EQUIPMENT DESCRIPTION

| A. Standard Engine | |
|---|---|
| 1. Description | |
| Truck Engine | 6 in-line OHV |
| Bore | 4.00" |
| Stroke | 3.18" |
| Displacement | 240 cu. in. |
| Compression Ratio | 8.5 |
| Cylinder Numbering | Front to Rear, 1-2-3-4-5-6 |
| Firing Order | 1-5-3-6-2-4 |
| Spark Plugs | BF 82 |
| Spark Plug Gap | 0.034" |
| Basic Timing | 6° BTDC @ 700 rpm, vac. discon. |
| Breaker Gap | 0.019" |
| Oil Capacity | 5 quarts |
| Carburetor | Standard commercial model |

TABLE

Carburetor Detergency Engine Test
The inhibitors were blended in a gasoline comprising 40% catalytically cracked component, 40% catalytically reformed component, and 20% alkylate of approximately 90–140° F. boiling range

| Compound | Conc. Lbs./ 1000 Bbls. | Reduction in Deposits, % |
|---|---|---|
| Base Fuel | 0 | 0 |
| Base Fuel + Ex. 1 | 15 | 25 |
| Base Fuel + Ex. 2 | 15 | 35 |
| Base Fuel + Ex. 3 | 15 | 45 |
| Base Fuel + Ex. 4 | 15 | 41 |
| Base Fuel + Ex. 5 | 15 | 55 |
| Base Fuel + Ex. 6 | 15 | 70 |
| Base Fuel + Ex. 7 | 15 | 67 |

It is readily apparent as stated hereinabove from the data of the Table that the additives of the present invention as described and claimed are highly effective in reducing the formation of carbonaceous deposits from liquid hydrocarbon fuels onto surfaces of various parts of internal combustion engines. It will, however, be understood that although the present invention has been described with preferred embodiments, modifications and adaptations thereto may be resorted to without departing from the spirit and scope of the invention as those skilled in the art will readily understand.

I claim:

1. A composition comprising a major amount of a liquid hydrocarbon fuel having an initial boiling point of at least about 75° F. and an end boiling point of about 750° F., and a minor amount sufficient to improve the fuel detergency thereof of the reaction product of an ester of a benzophenone tetracarboxylic dianhydride or mixtures of such esters and an amine wherein said benzophenone tetracarboxylic dianhydride ester or mixtures of such esters are reacted with the amine in a mole ratio of from about 3:1 to about 1:3 at a temperature of from about 100°–300° C. at atmospheric pressure from about three to about 10 hours.

2. The composition of claim 1 wherein said benzophenone tetracarboxylic dianhydride reactant is the reaction product of a mixture of an enter of a benzophenone tetracarboxylic dianhydride and a $C_1$ to about a $C_{72}$ alkanol.

3. The composition of claim 2 wherein the mole ratio of the later of the benzophenone tetracarboxylic dianhydride to alkanol to produce an ester thereof is from about 1:4 to about 4:1.

4. The composition of claim 3 wherein the alkanol is isodecanol.

5. The composition of claim 4 wherein the amine is tetraethylenepentamine.

6. The composition of claim 1 wherein said minor amount is the reaction product of an ester of a benzophenone tetracarboxylic dianhydride or mixtures of such esters and a mixture of branched $C_{12}$ primary amines.

7. The composition of claim 1 wherein the product is the reaction product of an ester of a benzophenone tetracarboxylic dianhydride and a mixture of primary $C_{16-18}$ amines derived from tallow.

8. The composition of claim 1 wherein the product is the reaction product of an ester of a benzophenone tetracarboxylic dianhydride acid and an aminopropyl-substituted oleylamine.

9. The composition of claim 1 wherein the product is the reaction product of benzophenone tetracarboxylic dianhyride further reacted with a succinimide.

10. A fuel detergent, intake valve and exhaust gas recirculation liquid hydrocarbon valve deposit reduction additive product as defined in claim 1, 5, 6, 7, 8 or 9.

* * * * *